US006658669B1

(12) United States Patent
Addington et al.

(10) Patent No.: US 6,658,669 B1
(45) Date of Patent: Dec. 9, 2003

(54) BOWLER'S FINGER SUPPORT AND CONTROL

(76) Inventors: Randall A. Addington, 2457 St. Johns, Melbourne, FL (US) 32953; W. Robert Addington, 2457 St. Johns, Melbourne, FL (US) 32953; W. Robert Addington, II, 2457 St. Johns, Melbourne, FL (US) 32953; Joel I. Rosenblatt, 445 11th Ave., Indialantic, FL (US) 32903

( * ) Notice: Subject to any disclaimer, the term of this patent is extended or adjusted under 35 U.S.C. 154(b) by 69 days.

(21) Appl. No.: 10/064,390

(22) Filed: Jul. 9, 2002

(51) Int. Cl.[7] ..... A41D 19/00
(52) U.S. Cl. ..... 2/161.1; 2/16; 2/163; 473/61
(58) Field of Search ..... 2/16, 20, 160, 2/161.1, 161.2, 161.4, 161.5, 163, 162; 473/54, 55, 59–61

(56) References Cited

U.S. PATENT DOCUMENTS

| | | | | | |
|---|---|---|---|---|---|
| 3,152,337 | A | * | 10/1964 | Barry | 2/159 |
| 3,208,749 | A | * | 9/1965 | Skuse | 2/159 |
| 3,333,850 | A | * | 8/1967 | Miller | 2/159 |
| 3,344,436 | A | * | 10/1967 | Stubbs | 2/159 |
| 3,408,657 | A | * | 11/1968 | Gallagher | 2/159 |

* cited by examiner

*Primary Examiner*—Katherine Moran
(74) *Attorney, Agent, or Firm*—Joel I. Rosenblatt

(57) ABSTRACT

An adjustable tensioning strap is mounted in a glove worn on the bowling hand and connecting the glove finger tip and an anchor point proximate the wrist or palm. The tensioning strap, from the finger tip to the anchor point, is held adjacent the glove lining so when placed on the hand and with tension applied to the tensioning strap, the tensioning strap is held or forced by the glove toward and substantially adjacent the bowler's finger and palm.

46 Claims, 4 Drawing Sheets

(right handed bowler)

(left handed bowler)

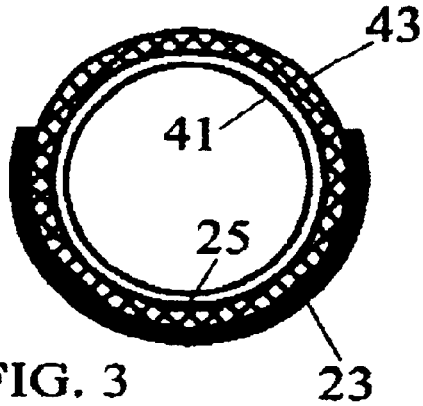
FIG. 3
FIG. 3a
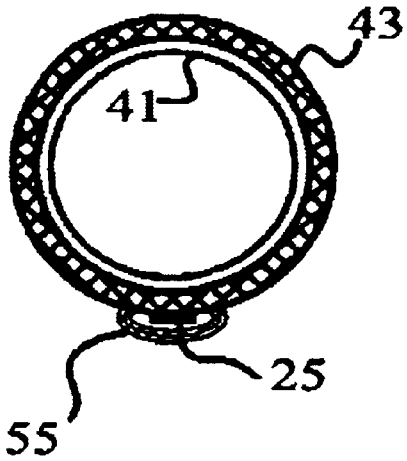
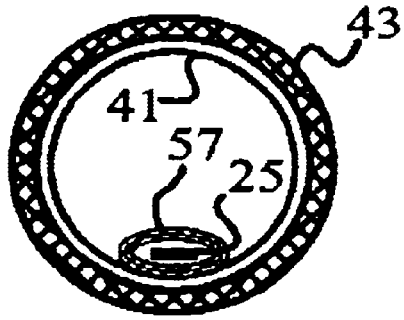
FIG. 3b (right handed bowler)

(left handed bowler)

BOWLER'S FINGER SUPPORT AND CONTROL

BACKGROUND OF INVENTION

In order for a bowler to have the greatest advantage in his attempt to consistently score the maximum number of pins, the bowling ball is released from one or more of the middle fingers by applying pressure to ball through the bowling ball finger holes in a complex motion known to those skilled in the art as lift, Lift, as known in bowling and as shown for example in U.S. Pat. 4,371,163 of Shaffer, means imparting to the ball the two rotary motions of roll and spin. To achieve roll, tie ball is made to rotate in a forward and downward direction relative to the horizontal axis alone the direction of travel of the ball toward the pins and to achicve spin, the ball is made to rotate with a rotational component about the vertical axis of the ball, as viewed from above a ball thrown with the right hand. It is the spin that causes a desired scattering of the falling pins, increasing the chance for a strike.

A stated above, this complex motion of imparting two rotary motions of roll and spin is known to those skilled in the art as lift. Lift is produced, after the thumb has been removed from the ball, by one or more of the middle fingers applying a force to the ball at its release to rotate the ball upward, imparting the desired roll and spin. To perform this operation in the best manner requires the bowler, in releasing the ball, to consistently apply his maximum force through one or more of the bowler's middle fingers, against the interior surface of the bowling ball finger hole. In bowling, this operation is repealed from a minimum of twelve for a perfect game, to a maximum of twenty one times, depending on the bowler's success in scoring a strike or spare in the last regular frame. Multiplied by a number of games, for example in league play, there is typically three full games with a minimum of thirty six ball released to it maximum of sixty three balls released. The multiplied acts of bowling, involving lifting the ball on its release, produces multiple strains and stresses on the bowler's finger. Critical to properly lifting and releasing the bowling ball, is maintaining the best possible positioning of the middle finger or fingers against the bowling hall hole, to consistently apply the proper amount of lift to the ball. As the hard surface of the bowling ball finger hole is continually forced against the bowler's extended finger, producing stress and strain in the finger, the ability of the bowler to maintain consistent control through middle ringer or fingers at the ball release, is reduced, detrimentally affecting the bowler's ability to consistently lift the ball and consistently score strikes.

In attempts to adjust the curved position of the finger, a strap was used as shown in U.S. Pat. Nos. 3,152,337 and 3,880,426. As shown therein the strap was adjustable relative to an anchor point on the wrist. However the devices as shown in these patents placed the strap in a straight line locus from the curved finger tip area to the anchor point, imposing a space between the strap and the finger and palm. The size or depth of the space was relative to the adjustment made to the position of the finger tip, the amount of tension applied to the strap, the curve produced in the finger, and the relative placement or disposition of the strap to the wrist anchor point. As a consequence, when the bowler placed his finger into the bowling ball finger hole with the finger and palm forced against the ball, the strap extending in a line from the curved finger to the wrist anchor point, was forced against the finger and palm, changing the straight line locus of the strap from the finger to the anchor point, to a curved line locus from the finger to the palm and changing the original adjustment to the strap and its force on the finger, as previously made by the bowler.

SUMMARY OF INVENTION

As shown herein, in a preferred embodiment, this invention according to the inventive principles disclosed, in an embodiment is an adjustable tensioning strap mounted in a glove adapted to be worn on the bowling hand and connecting or terminating at a first end proximate the glove finger tip or a finger pad protector placed at the glove finger tip and disposed opposite the position of the bowler's finger pad, and at a second end, at an anchor point proximate the glove part enclosing the wrist or palm. The tensioning strap, from its first end to its second end, is held adjacent the glove lining so when placed on the hand and with tension applied to the tensioning strap, a curve is produced in the finger while the tensioning strap is held or forced by the glove toward and substantially adjacent the bowler's finger and palm, and describing a curved line locus from the first end to the second end of the tensioning strap and with the curved locus substantially adjacent the length of the bowler's finger or palm.

The tensioning strap may be adjusted relative to the second anchor point proximate the glove palm or wrist, by applying a tensioning force in a direction away from the finger tip and in the direction from the finger to the wrist and whereby the tensioning force on the tensioning strap will serve to draw the finger into a curved position with the finger tip pulled toward the wrist. The adjustment is variable depending upon the needs of the individual bowler when grasping the bowling ball and when in the initial part of the ball release when the bowler's arm is in an up swing, and when the bowler is starting his release by initiating a lifting force through the middle fingers, as would be known to those skilled in the art.

In accordance with the principles of the disclosed invention, the tension strap may be an elastic material, stretching or elongating under a tension force or substantially non-elastic and substantially not stretching or elongating under a tension force, according to the disclosed principles of the invention as shown for a preferred embodiment. When substantially non-elastic, the tension strap may be adjusted with the middle finger in an extended or neutral position, relative to a curved or flexed position, to resist the force of the bowling ball at release and to support the middle finger from being forced backward in a hyper-extended position where stress or strain would be imposed on the finger. For an elastic tension strap, the elastic resistance to a tension force may be varied to produce a restoring force in the tension strap when the middle finger is extended in a neutral position, to substantially to resist the force of the bowling ball at release and to support the middle finger from being forced backward in a hyper-extended position where stress or strain would be imposed on the finger.

The tensioning strap may be an elastic or stretchable material so the finger may be extended against the tensioning force of the strap in the process of releasing and lifting the ball. In this way the curved position of the finger and the force holding the finger in its curved position and through its extended position when releasing and lifting the bowling ball, as explained above, may be adjusted by each individual bowler. As the restoring force exerted by an elastic material is proportional to its stretched extension, relative to its relaxed or rest position, as would be known by those skilled in the art, the force exerted by the tensioning strap against the finger is proportionally greatest when the finger is fully extended. This restoring force produced in the tensioning strap, acts in the direction of finger flexure and away from the finger tip and towards the palm or wrist, to force the finger to retain its adjusted curved position and to resist the force of the bowling ball on the bowler's finger at the ball release which is a direction of finger hyper extension, forcing the curve of the finger to open or if the finger is fully extended, to force the finger back past an extended neutral position into a hyper extended position and placing additional strain and stress on the finger. The adjustment made by the bowler using the tensioning strap adjustment and the force of the adjusted tensioning strap against the finger tip, adjusts the bowler's finger into an adjusted curved position, whereby the tensioning strap force can resist or counter balance the opposite force of the bowling ball against the finger tip in the direction of hyper extension, at the ball release and thereby reduce the stress and strain placed on the finger.

According to the principles of the disclosed invention, the finger pad protector may comprise a finger pad protector protecting the finger pad and a part of the finger extending from the finger pad toward the first or second finger joint.

As force is applied to the tensioning strap, forcing the finger toward an adjusted curved position, the tension force in the tensioning strap will be forcing the locus described by the tensioning strap into a straight line. However, according to the principles of the disclosed invention, and as disclosed in a preferred embodiment, herein, a substantially transverse force is applied to the tensioning strap forcing it in a locus described by a curved line substantially following the adjusted curve of the finger.

As shown in a preferred embodiment, and according to the principles of the disclosed invention, the force holding the tensioning strap adjacent the finger and palm, may be produced by the glove lining forming a conduit for the tension strap and which forces the locus of the tension strap from its first connection proximate the finger tip or finger pad to the second adjustable connection, into an adjusted curved position, as described by a line from the first tension strap connection to the second tension strap connection, substantially following the adjusted curve of the finger and substantially adjacent the finger or palm. In this way, there is substantially no space imposed between the tensioning strap and the finger or palm, as in the patents cited above, to be taken or removed when the bowler grips the ball, and the locus of the tensioning strap as initially adjusted, is not affected when the bowler places his finger in the bowling ball hole and forces the glove and tensioning strap disposed substantially adjacent finger and palm, against thee bowling ball surface.

Accordingly, it is an object of this invention to use a tension strap to adjust the curved position of the bowler's finger and to support the bowler's finger against the force of the bowling ball, when the bowler's is extending the finger in the release and lifting of the bowling ball.

In a preferred embodiment, the tensioning strap may be on a non elastic material and adjusted to be held in tension when the finger is substantially in its extended or neutral position. Where the tensioning strap is not flexible or non-elastic, it provides a counter force against a force against the finger tip in the direction past the neutral position and into a hyper extended position. In operation, the non-elastic tensioning strap is adjusted with the middle finger in the extended neutral position. As the tension strap is held in tension, the force from the bowling ball produced when the ball is released and in the direction against the finger tip, forcing the finger into a hyper extended position, is substantially counterbalanced by the force in the tension strap, thereby supporting the finger and preventing hyper-extension. To prevent hyper extension of the middle finger from a neutral position and in a preferred embodiment where the tension strap is elastic, the tension strap may be adjusted so the elastic restoring force produced in the stretched tension strap, substantially counterbalances the force of the bowling ball against the middle finger in the direction of hyper extending the middle finger.

The following is shown and described according to the disclosed inventive principles.

A bowler's glove covering the bowler's middle finger and hand, and proximate the bowler's wrist and including an adjustable tensioning strap to adjust the middle finger into a curved position and to anchor the tensioning strap in the adjusted curved position, comprising, a first means connected at a first end proximate a middle finger tip, for applying a first force to said middle finger; said first means including a second means for adjustment of said first means for adjusting said middle finger to an adjusted curved position; third means for anchoring said second means, proximate the wrist; d. fourth means for retaining said first means substantially against the length of said middle finger opposed to said first means, when said middle finger is in said adjusted curved position.

A bowler's glove enclosing a bowler's hand and at least one middle finger, comprising, an adjustable connection; a tension strap adjustably connected by said adjustable connection and to said middle finger; said tension strap responsive to a displacement of said adjustable connection for applying a tension force to said middle finger for placing said middle finger part into an adjusted curved position;said hand and said middle finger including a conduit, whereby said tension strap is retained inside said conduit and against said middle finger part substantially opposed to said tension strap, when said middle finger is in said adjusted curved position.

All of the patents cited above are incorporated herein by reference.

BRIEF DESCRIPTION OF DRAWINGS

FIG. 3 shows a cross section of the glove finger proximate the finger pad and with tension strap between the glove inner and outer layers and with finger pad protector located proximate the finger tip.

FIG. 3*a* shows the cross section of the glove finger of FIG. 3 with the tension strap in a conduit adjacent the glove outer lining but without the finger pad protector as shown in FIG. 3, for the purpose of explanation.

FIG. 3*b* shows the cross section of the glove finger of FIG. 3 with the tension strap in a conduit adjacent the glove outer lining.

FIG. 3*b* shows the cross section of the glove finger of FIG. 3 with the tension strap it a conduit adjacent the glove inner lining but without the finger pad protector as shown in FIG. 3, for the purpose of explanation.

DETAILED DESCRIPTION

Figure 1:
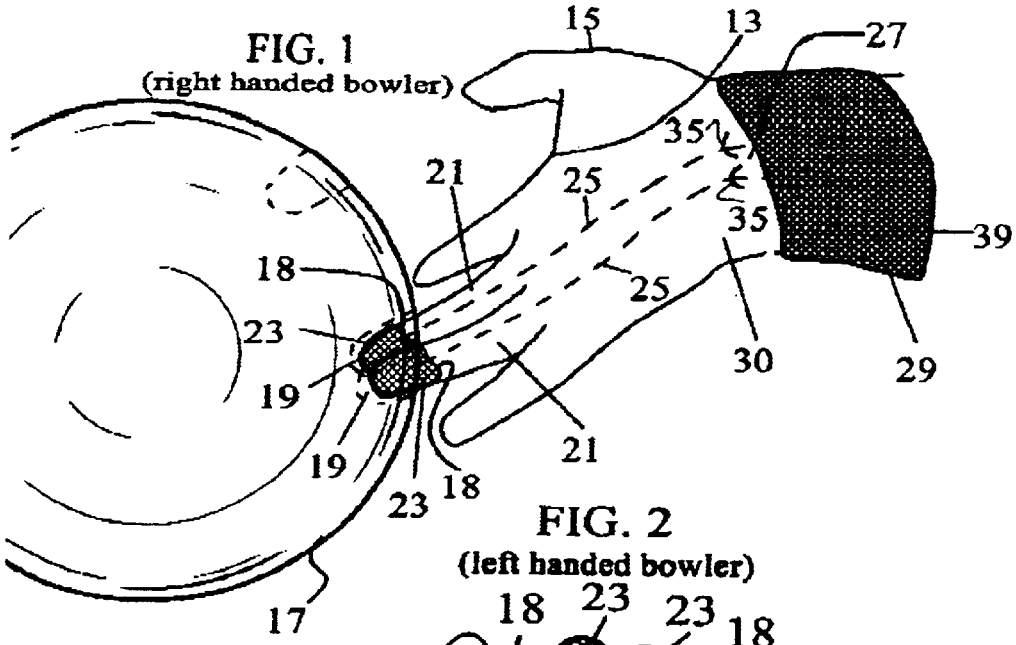
FIG. 1 shows the bowler's fingers in an extended position in the release of the bowling ball with the tension straps shown in phantom mounted in a right handed glove and extending from proximate the finger tip to an anchor point proximate the bowler's wrist, and with the straps anchoring the tension strap in a closed or anchor position.

In the drawings shown herein, the same numerals are used to show the same or similar parts.

FIG. 1 shows the invention in a bowler's right handed bowling glove 11 with thumb opening 13 for thumb 15. The bowler's glove is shown on the bowler's right hand with the bowler's finger tips 18, inside the bowling ball 17, finger holes 19, at the moment of the ball release and with the fingers 21 extended in a substantially neutral position, as would be known to those skilled in the art of bowling, to lift the ball and impart rotation and spin. In FIG. 1, two middle fingers 21 are shown but as would be known to those skilled in the art, any combination of middle fingers may be used to lift and release the ball and the inventive principles are not limited to the number or combination of fingers used to bowl.

Finger pad protectors 23 are shown proximate the glove finger tips 18. The finger pad protectors 23 add additional protection for the finger tips 18 from the force of the bowling ball at its release. The finger pad protectors according to a preferred embodiment, may be limited to the finger tip or may extend to the first finger joint. Tension straps 25 are shown (in phantom) in a path or locus between the inner and outer glove layers and extending from a first connection 28 (shown in FIGS. 2,4, and 5), generally shown proximate the finger tips 18 to a second connection at an anchor point 27 (shown in FIG. 1), proximate the bowler's wrist 29 or palm 30.

Figure 2:
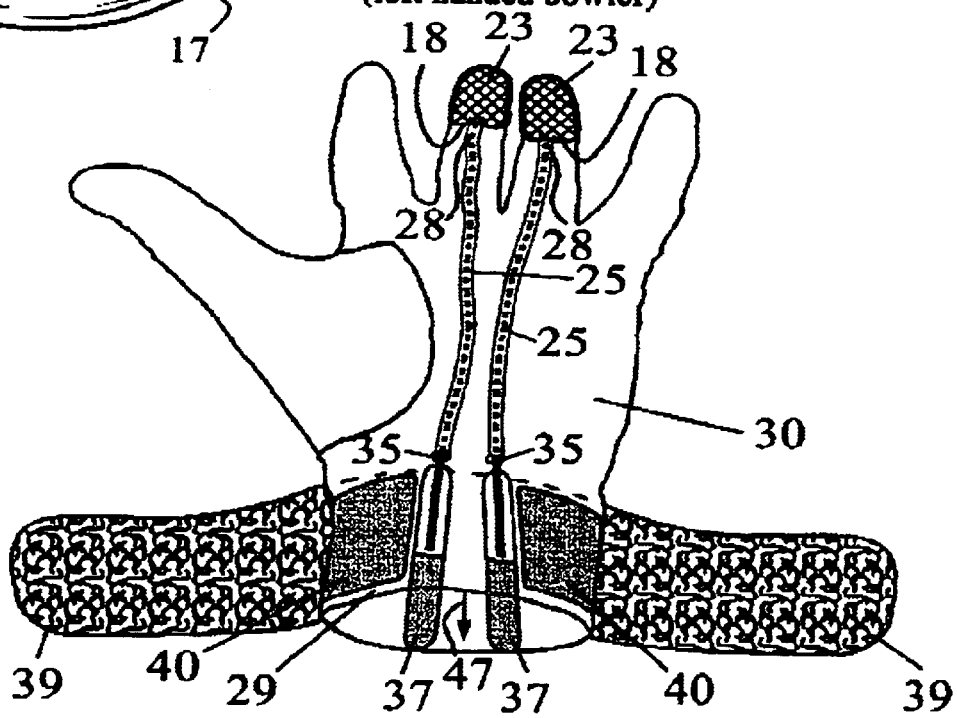
FIG. 2 shows the glove of FIG. 1 in a view toward the palm and on a left handed bowler with the tension straps shown in phantom, adjusted to produce a curve in the middle fingers and with the wrist mounted anchor straps open. and the tension strap anchor tabs exposed for view.

The invention shown in FIG. 1 is shown in FIG. 2, reversed in a left handed glove with the same or similar parts having the same numerals. The use of a right handed glove in FIG. 1 and a left handed glove in FIG. 2 is made to demonstrate the invention may be used by right or left handed bowlers without departing from the principles of the disclosed invention. The tension straps 25 are shown in a preferred embodiment for example, terminated at first connection point 49, proximate the finger tip shown in FIG. 4 at a location which is proximate the finger tips 18 and finger pad protector 23 and which may be varied in that proximately given location as shown and described with reference to FIG. 1 and FIG. 2, herein The tension strap 25 connection 49, is shown as stitched to the glove lining, shown generally in FIG. 4 by numeral 42, but as would be known to anyone skilled in the art, any suitable connection of the tensioning strap to the finger tip may be used, as now or hereafter known.

Figure 4:
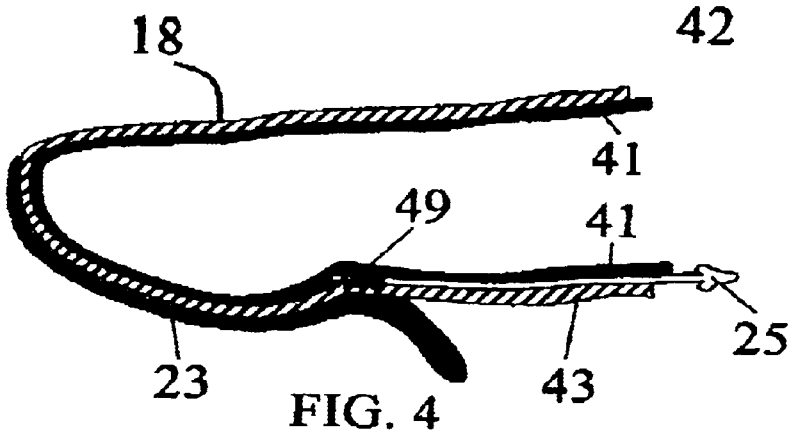

In a preferred embodiment, the tension straps 25 are placed between the inner lining 41 and outer lining 43 of the glove and held thereby substantially adjacent the opposed finger and palm as shown in FIGS. 3 and 4. The tensioning straps may be brought out of the glove lining at glove openings 35 and terminated in anchoring tabs 37 which are used to hold the tensioning strap in its adjusted position, in connection with anchor straps 39, as shown in FIGS. 2 and 6, in an open position and in FIG, 1 and 5, in a closed position, as explained below. The tension straps 25 may be retained substantially adjacent the glove lining as shown by placing the tensioning straps within a conduit formed by the glove lining as showing in FIGS. 3 and 4 or an adjacent conduit formed exterior, or interior to the glove outer or inner lining, respectively, as would be understood by those skilled in the art from a description of a preferred embodiment and according to the inventive principles disclosed herein. The conduit may be formed as shown within the glove inner and outer linings as shown in FIG. 3, or as shown in FIG. 3*a*, by an additional layer forming a conduit 55 placed contiguous to the outer lining or exterior 43 as shown in FIG. 3*a*, and in FIG. 6, or by an additional layer forming a conduit 57 contiguous to inner lining or interior 41, as shown in FIG. 3*b*. For the purpose of explanation, the finger pad protector 23, shown in FIG. 3, is not shown in FIG. 3*a* or 3*b*, but which would be understood by those skilled in the art as located proximate the finger tip 18, as shown in FIGS. 1, 2, 4, 5 and 6. As would be understood by those skilled in the art from a description of a preferred embodiment and disclosure of the inventive principles, herein, the conduit 57 enclosing tension strap 25, may be placed in the interior of the glove lining, shown generally in FIG. 4 by numeral 42, adjacent inner lining 41. According to the disclosed inventive principles, a separate conduit, as shown by numeral 57 in FIG. 3*b*, may be attached to the inner lining 41 of the glove lining 42 and the tension 25 strap contained therein, without departing from the disclosed inventive principles. As would be understood by those skilled in the art from a description of a preferred embodiment and disclosure of the inventive principles, herein, the conduit 57, enclosing tension strap 25, may be placed adjacent the inner lining 41 and its counterpart conduit 55 may be placed adjacent the outer lining 43, of the glove lining shown generally by numeral 42 without departing from the disclosed inventive principles.

The means for anchoring the tensioning strap at the second connection may be anchor tab 37 as shown in a preferred embodiment which may be made with a VELCRO hook and loop type, fastening material for cooperation as known to those skilled in the art, with VELCRO hook and loop type, fastening material on straps 39, and with a VELCRO hook and loop type, fastening material on complementary strap surface 40. As would be apparent to those skilled in the art, the VELCRO hook and loop type, fastening material surfaces could be reversed and other means known by those skilled in the art could be used to anchor the tensioning strap in its adjusted position, without departing from the principles of the disclosed invention.

Figure 5:
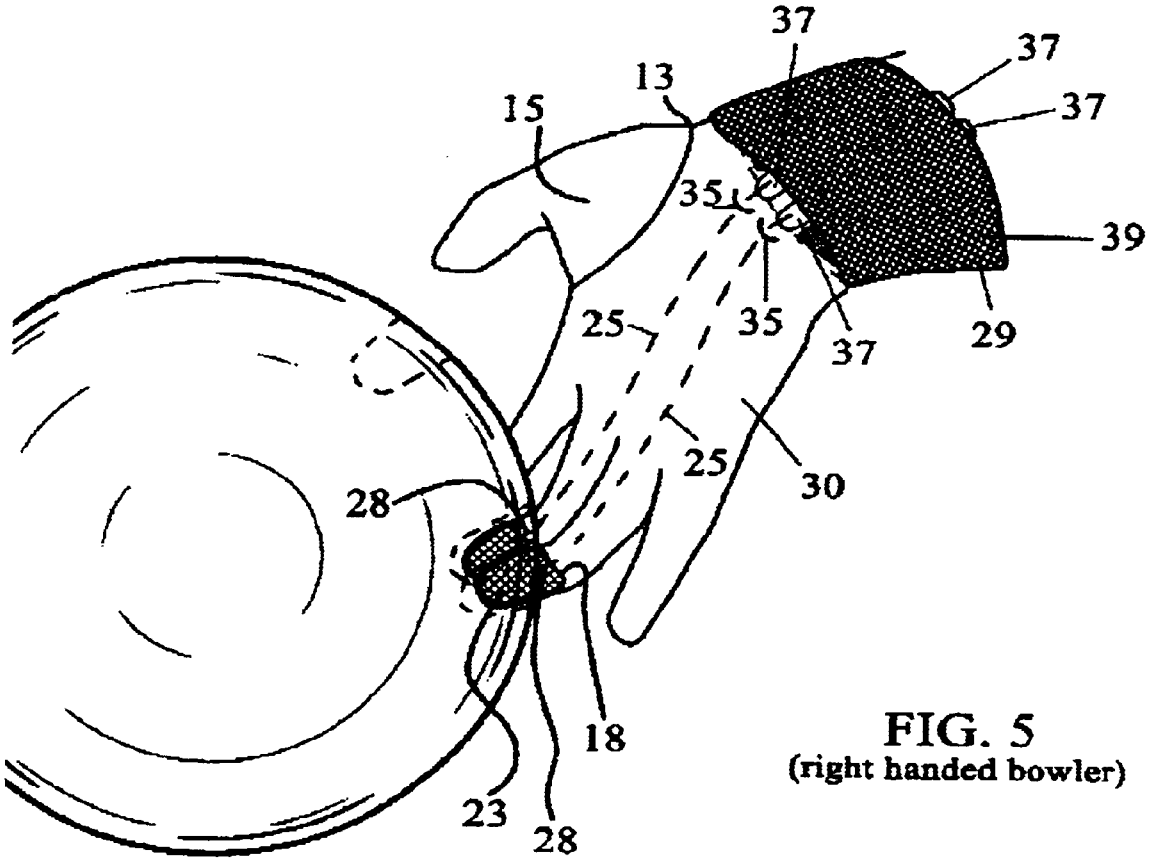
FIG. 5 shows the glove of FIG. 1 with bowler's fingers in an adjusted curved position when starting the release of the bowling ball.
Figure 6:
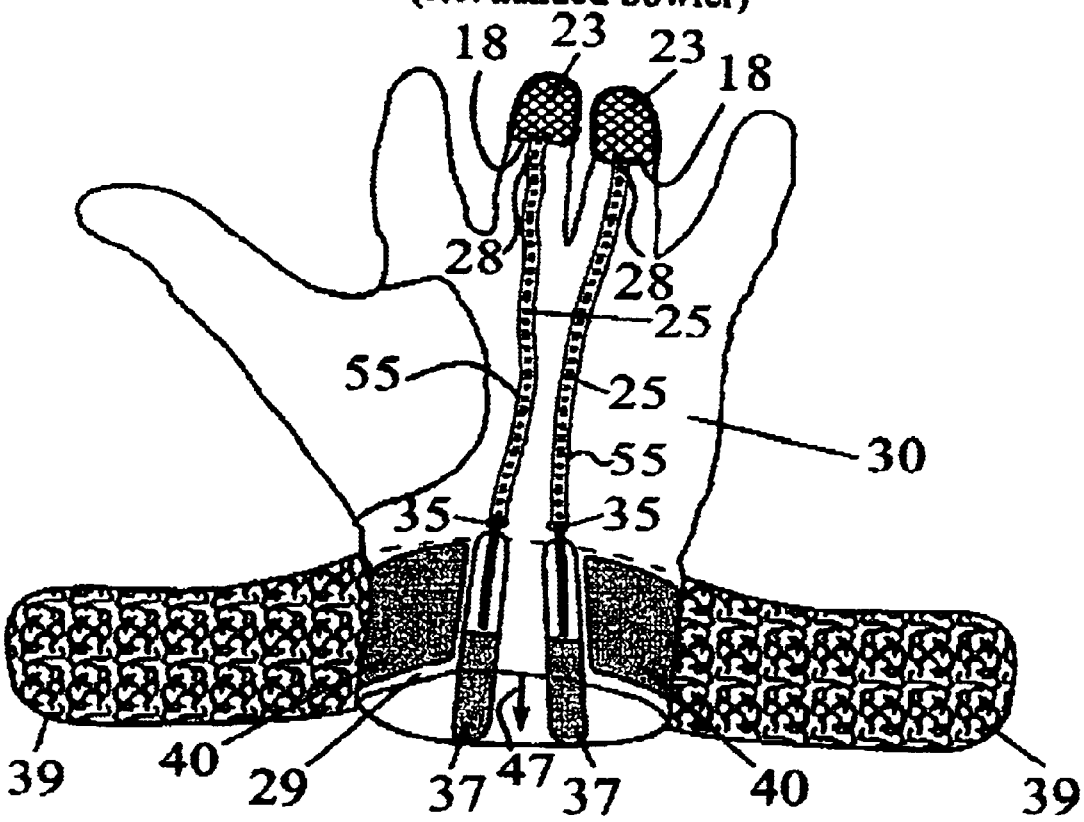
FIG. 6 shows the bowler's fingers in an extended position in the release of the bowling ball with the tension straps shown in phantom mounted within an exterior conduit in a left handed glove and with the exterior conduit extending from proximate the finger tip to an anchor point proximate the bowler's wrist, and with the straps anchoring the tension strap in a closed or anchor position.

In operation, the anchor tabs 37, as shown for a preferred embodiment, can be pulled in the direction of arrow 47, away from the opposed tensioning straps 25 and the first connection 28 proximate the finger tips 18, thereby pulling the fingers tips 18 and the fingers 21 into an adjusted curved position, as shown in FIGS. 2 and 5, relative to its extended position as shown in FIG. 1. In FIGS. 2 and 5, the two middle fingers are shown foreshortened in FIG. 2 and curved in FIG. 5, as pulled into a curved position by displacing the anchor tabs 37 in the direction of arrow 47 and drawing the finger tips 18 toward the anchor strap 39, so the curved fingers are flexed and concave relative to a view from the palm.

The straps 39 upper and lower linings and the surface of the anchor tab 37, may be made of complementary VEL- CRO hook and loop type, fastening material, so one of the straps 39, for example the right side strap as shown in FIG. 2, may be wrapped over the anchor tabs 37 in their adjusted position, locking the anchor tab 37 in place, and then the second strap or left side strap, may be wrapped over the first strap with the opposed straps engaged by their respective complementary VELCRO hook and loop type fastening material surfaces.

According to the inventive principles disclosed, the adjustment made to the tensioning straps and the adjusted amount of curvature of the middle finger 21 may be made variable by the variable displacement of the tension straps 25 by an adjustable transverse displacement of anchor tabs 37 relative to the second connection anchor point proximate the wrist 29 or palm 30, with the curvature of the finger increasing as the tensioning straps 25 and the anchor tabs 37 are pulled in the direction of arrow 47 transverse across the bowler's wrist 29 and the cooperating parts of straps 39, and thereby applying a tension force to the tensioning straps 25 and through the tensioning straps 25, a force to the finger tips 18 to pull the finger tips toward the palm or wrist and into an adjusted curved position.

According to the disclosed inventive principles, the tension strap 25 may be an elastic material which allows the bowler to extend the middle finger 21 from its adjusted curved position as shown in FIG. 2 and FIG. 5. as when the ball is grasped, to its extended position as shown in FIG. 1, when the ball is released and lift is applied to the ball. A suitable elastic material would be known to those skilled in the art and does not form a part of the invention. The elastic material of the tension straps 25 produces all increasing flexing force on the finger tips 18 as the bowler is extending the gloved finger when releasing the ball anti applying lift to the ball, thereby forcing the finger toward its flexed or adjusted curved position. This increasing flexing force is directed against the extension of the finger and provides a counter force to the force of the bowling ball against the finger 21 which is directed in the hyper-extended position past the neutral position and which produces stress and strain on the finger. The elastic tension force may be adjusted by varying the elastic equality or quantity of the tension strap so the elastic restoring force, when the middle finger is fully extend my substantially counter balance the force of the bowling ball.

The anchor tabs 37 and the straps 39, and complementary strap surface 40, may be varied or changed, is would be known to those skilled in the art, to another suitable fastening device, without departing from the disclosed principles of the invention. In a preferred embodiment, complementary VELCRO hook and loop type, fastening material surfaces, are shown as a suitable means for fastening and holding the anchor tabs 37 in their adjusted position. In connection with anchor straps 39 and the length of the 39 anchor tabs 37, the respective length may be varied or other suitable anchoring means may be used as would be now or hereafter known by those skilled in the art, to extend the displacement range for displacing or moving the anchor tabs 37 or the tensioning strap 25 over and across the anchor means shown as strap 39, in the direction of arrow 47. According to the principles of the disclosed invention, while two anchor tabs 37 are shown, one or a combination of two or more anchor tabs may be used.

FIG. 5 shows the glove of FIGS. 1 and 2 with the fingers 25 in an adjusted curve position and with the tension straps 25 substantially adjacent the finger and palm. The anchor tabs 37 are shown under the straps 39 and in locked position.

What has been shown and disclosed herein is a bowler's glove with, a tensioning strap adjustably connected at a first location proximate the finger tip and at a second location proximate the wrist or palm, and with the adjustable connection being adapted to force the finger tip into a flexed or an adjusted curved position and with the glove holding the tensioning strap in an substantially adjacent relation with the finger or palm when the finger is in its adjusted curved position. The tensioning strap is shown as an elastic material so the force restoring the finger to its adjusted curved position when the finger is extended, as shown in FIG. 1, as for example when releasing the bowling ball, is directed to force the finger in the direction of flexure and toward its adjusted curved position.

In a preferred embodiment, the tension straps 25, as shown in FIG. 1, may be may of a non-elastic or non-stretchable material. When the non-elastic tensioning strap is adjusted with the finger held in tension by the tension strap 25 in a neutral position, for example, the tension strap 25 will resist the force of the bowling ball against the finger pad protector 23 and the finger tip 18, substantially preventing the finger from being forced into a hyper-extended position, supporting the finger and reducing stress or strain from the force of the bowling ball in its release.

As would be understood by those skilled in the art, by neutral position of the middle finger is meant the natural position of the finger fully extended. Flexure means bending of the finger in its natural curved position. Hyper-extension is the opposite of flexure and means bending of the finger past its neutral position.

As would be understood by those skilled in the art, the materials or locations of the elements shown to adjust the finger into its adjusted curved position or in its extended position and to hold the tension straps substantially against the finger, may be varied without departing from the disclosed principles of the disclosed and claimed invention.

What is claimed is:

1. A bowler's glove covering the bowler's middle finger and hand, and proximate the bowler's wrist and including an adjustable tensioning strap to adjust the middle finger into a curved position and to anchor the tensioning strap in the adjusted curved position, comprising, a. first means connected at a first end proximate a middle finger tip, for applying a first force to said middle finger;

b. said first means including a second means for adjustment of said first means for adjusting said middle finger to an adjusted curved position;

c. third means for anchoring said second means, proximate the wrist;

d. fourth means for retaining said first means substantially against the length of said middle finger opposed to said first means, when said middle finger is in said adjusted curved position.

2. The bowler's glove of claim 1, wherein said fourth means includes fifth means for forming a conduit within said glove, for said first means.

3. The bowler's glove of claim 1, wherein said fourth means includes sixth means for forming a conduit adjacent said glove, for said first means.

4. The bowler's glove of claim 1 wherein said first means includes seventh means for the extension of said first means in response to a tension force opposed to said third means.

5. The bowler's glove of claim 1, wherein said first means includes means responsive to an extension of said middle finger from said adjusted curved position for producing a counter force to extension.

6. The bowler's glove of claim 1, including means for protecting a bowler's middle finger pad.

7. The bowler's glove of claim 6, wherein said means for protecting said bowler's middle finger pad includes means proximate a first joint of said middle finger.

8. The bowler's glove of claim 1, wherein said second means includes means for displacement opposed to said middle finger and said first means is responsive to said means for displacement for applying a force in a first direction to said middle finger.

9. The bowler's glove of claim 8, wherein said first means is responsive to said means for displacement for applying a flexing force to said middle finger.

10. The bowler's glove of claim 8, wherein said first means includes means responsive to an extension of said middle finger from said adjusted curved position for producing a second force for restoring said first means to said adjusted curved position.

11. The bowler's glove of claim 10, wherein said second means includes means for displacing said first means in a first direction substantially from said middle finger to the wrist.

12. The bowler's glove of claim 1, wherein said fourth means includes means for producing a force directed substantially transverse to said force in a first direction for forcing said first means toward said middle finger in said adjusted curved position.

13. A bowler's glove enclosing a bowler's hand and at least one middle finger, comprising, an adjustable connection;

a tension strap adjustably connected by said adjustable connection and to said middle finger;

said tension strap responsive to a displacement of said adjustable connection for applying a tension force to said middle finger for placing said middle finger part into an adjusted curved position;

said hand and said middle finger including a conduit, whereby said tension strap is retained inside said conduit and against said middle finger part substantially opposed to said tension strap, when said middle finger is in said adjusted curved position.

14. The bowler's glove of claim 13, wherein, said conduit is positioned in said glove from said middle finger to force said tension strap toward said finger or said hand.

15. The bowler's glove of claim 13, wherein said middle finger includes a finger tip and a finger pad protector proximate said finger tip part for protecting the finger pad.

16. The bowler's glove of claim 13, wherein, said adjustable connection includes at least one anchor tab disposed proximate the wrist, and a strap disposed proximate said wrist for anchoring said anchor tabs over a range of said displacement of said anchor tabs, whereby said adjusted curved position may be fixed in place at any location within said range.

17. The bowler's glove of claim 13, wherein said tension strap is an elastic material.

18. The bowler's glove of claim 13, wherein said tension strap is elastic to be extendable in response to an extension of said middle finger from said adjusted curved position.

19. The bowler's glove of claim 13, wherein, said conduit is positioned to produce a force substantially transverse to said tension force.

20. The bowler's glove of claim 13, wherein said glove has at least an inner lining and an outer lining and said conduit is formed between said inner and said outer linings.

21. The bowler's glove of claim 13, wherein said conduit is within said glove.

22. The bowler's glove of claim 13, wherein said conduit is exterior to said glove.

23. A sports glove for use in bowling, with an adjustable tensioning strap attached to, and for use in supporting, a middle finger of a bowler in an adjustable curved position when releasing a bowling ball, while allowing the bowler to extend the middle finger in applying lift to the bowling ball, and with the glove forcing the tensioning strap substantially adjacent the bowler's finger or hand for at least a substantial length of the tensioning strap opposed to the finger or hand comprising, a. first means for enclosing a hand;

b. said first means including second means for adjusting a middle finger in an adjusted curved position;

c. said first means including third means for forcing said second means substantially adjacent said middle finger or said hand substantially along the length of said second means opposed to said middle finger or said hand.

24. The sports glove of claim 23, wherein said third means includes means for holding said second means substantially adjacent the length of said middle finger.

25. The sports glove of claim 23, wherein said third means includes means for holding said second means substantially adjacent the palm of said hand.

26. The sports glove of claim 23, wherein said second means includes means for extending said first means in response to an extension of said finger from said adjusted curved position.

27. The sports glove of claim 23, wherein said second means includes means for producing a first force directed from said middle finger to said hand and said third means includes means for producing a second force directed against first force and toward said hand.

28. The sports glove of claim 23, wherein said third means includes means for holding said second means.

29. The sports glove of claim 28, wherein said means for holding said second means includes means for holding said second means in said first means.

30. A method using a bowler's glove to adjust the middle finger into a curved position under the force of an anchored tensioning strap, for use when releasing a bowling ball and applying lift to the bowling ball, comprising the steps of, a. attaching a tension strap proximate a middle finger tip;

b. adjusting said tension strap with a first said proximate said middle finger tip, for adjusting said middle finger to an adjusted curved position;

c. anchoring a second end of said tension strap, proximate the wrist, d. holding said tension strap substantially against the length of said middle finger when said middle finger is in said adjusted curved position.

31. The method of claim 30, wherein said step of holding said tension strap substantially against said middle finger, includes the step of placing said tension strap substantially within a conduit within said glove.

32. The method of claim 30, wherein said step of holding said tension strap substantially against said middle finger, includes the step of placing said tension strap substantially within a conduit exterior to said glove.

33. The method of claim 30, including the step of adjusting an elastic tension strap.

34. The method of claim 30, including the step of mounting a finger pad protector on said middle finger.

35. The method of claim 30, wherein said step of holding said tension strap substantially against said middle finger, includes the step of applying the force of said glove against tension strap.

36. A bowler's glove having a part for covering the bowler's middle finger and a part for wearing over the bowler's hand, and proximate the bowler's wrist and including an adjustable tensioning strap to hold the middle finger against hyper-extension from a substantially neutral position, comprising, a first means connected at a first end proximate said middle finger tip, for applying a first force to the middle finger in the direction of flexure of said middle finger; and wherein said first means including fourth means for substantially preventing displacement of said frist means by a second force opposed to said first force; and wherein, said first means includes a second means for adjustment of said first means, for adjusting said middle finger substantially to an adjusted extended neutral position: third means for anchoring said second means, proximate the wrist; and wherein said first is force is opposed to said second force directed against said middle finger in a direction of hyper-extension and said fourth means substantially counter balances said second force for holding said middle finger in said extended neutral position.

37. A bowler's glove having a part for covering the bowler's middle finger and a part for wearing over the bowler's hand, and proximate the bowler's wrist and including, an adjustable tensioning strap to hold thee middle finger against hyper-extension from a substantially neutral position, comprising first means connected at a first end proximate said middle finger tip, for applying a first force to the middle finger in the direction of flexure of said middle finger said first means including fourth means for substantially preventing displacement of said first means by a second force opposed to said first force, and wherein, said first means includes a second means for adjustment of said first meat's, for adjusting said middle finger substantially to an adjusted extended neutral position; third means for anchoring said second means, proximate the wrist; and wherein said first force is opposed to said second force directed against said middle finger in a direction of hyper-extension and said first force of said fourth means substantially counter balances said second force for holding said middle finger in said extended neutral position.

38. An adjustable tensioning strap system connected to a bowler's middle finger tip for adjustment of a middle finger into an adjusted curved position, and for holding the adjustable tensioning strap against the middle finger in its adjusted curved position, comprising, a. first means for applying a first force to a middle finger tip and for adjustment of said middle linger to an adjusted Curved position; said first means including second means for connection of said first means to said middle finger tip with said first means opposed to said middle finger;

b. third means for anchoring said second means;

c. fourth means for applying a force against first means for holding said first means substantially adjacent, and substantially following, the curved length of said middle finger in said adjusted curved position.

39. The adjustable tensioning strap of claim 38, wherein substantially no space is imposed between said first means and said curved length of said middle finger; whereby, said adjusted curved position is substantially unaffected by placement of said first means against the surface of a bowling ball.

40. The adjustable tensioning strap of claim 39, wherein said first means includes means for adjusting said middle finger substantially to an adjusted extended neutral position; and wherein said first force is opposed to a force directed against said middle finger in a direction of hyper-extension, for holding said middle finger in said extended neutral position.

41. A bowler's aid with adjustable tensioning strap connected to a bowler's middle finger tip for adjustment of a middle finger into a curved position with the adjusted tensioning ;trip substantially adjacent the length of the middle finger opposed to said tensioning strap, and whereby the adjustment of said middle finger is substantially unaffected by placement of the middle finger and the tensioning strap against the bowling ball surface, comprising;

a. an adjustable tensioning strap;

b. said adjustable tensioning strap including a connector adapted for connection of said adjustable tensioning strap to a middle finger tip;

c. said adjustable tensioning strap including an anchor adapted to anchor said adjustable tensioning strap, at an end opposed to said connector;

d. a covering for said adjustable tensioning strap, located against said adjustable tensioning strap and said middle finger, e. said adjustable tensioning strap adapted to draw said middle finger into an adjusted curved positions and f. said covering adapted to apply a substantially transverse force to said adjustable tensioning strap and to force said adjustable tensioning strap into a locus described by a curved line substantially following said adjusted curved position.

42. The bowler'said of claim 41, wherein said covering is a glove with a glove inner and outer lining enclosing said adjustable tensioning strap.

43. The bowler'said of claim 41, wherein said covering is a glove with an inner and outer lining and with a conduit, located adjacent said inner lining of said glove.

44. The bowler'said of claim 41, wherein said covering is a glove with an inner and outer lining and with conduit, located adjacent said outer lining of said glove.

45. The bowler'said of claim 41, including a a finger pad protector proximate said middle finger tip for protecting the finger pad.

46. A bowler's glove enclosing a bowler's hand and at least one middle finger, comprising, an adjustable connection:

a tension strap adjustably connected by said adjustable connection and to said middle finger, said tension strap responsive to a displacement of said adjustable connection for applying a tension force to said middle finger for placing said middle finger part into an adjusted curved position, said hand and said middle finger including a conduit, whereby said tension strap is retained inside said conduit and against said middle finger part substantially opposed to said tension strap when said middle finger is in said adjusted curved position, and wherein;

said adjustable connection includes at least one anchor tab disposed proximate the wrist, and a strap disposed proximate said wrist for anchoring said anchor tabs over a range of said displacement of said anchor tabs, whereby said adjusted curved position may be fixed in place at any location within said range.

* * * * *